US006869166B2

(12) United States Patent
Brugue et al.

(10) Patent No.: US 6,869,166 B2
(45) Date of Patent: Mar. 22, 2005

(54) MULTI-DIE FLUID EJECTION APPARATUS AND METHOD

(76) Inventors: Joaquim Brugue, Avda. Graells 501, 08190 St. Cugat (ES); Luis Hierro, Avinovda Graells 501, 08190 St.Cugat (ES)

( * ) Notice: Subject to any disclaimer, the term of this patent is extended or adjusted under 35 U.S.C. 154(b) by 0 days.

(21) Appl. No.: 10/409,853

(22) Filed: Apr. 9, 2003

(65) Prior Publication Data

US 2004/0201641 A1 Oct. 14, 2004

(51) Int. Cl.[7] ..... B41J 2/155
(52) U.S. Cl. ..... 347/49; 347/13; 347/42
(58) Field of Search ..... 347/13, 42, 49, 347/40, 50, 12, 56, 59

(56) References Cited

U.S. PATENT DOCUMENTS 5,057,854 A 10/1991 Pond et al. ..... 346/140
5,160,945 A 11/1992 Drake ..... 346/140
5,469,199 A 11/1995 Allen et al. ..... 347/42
6,053,598 A * 4/2000 Inpyn ..... 347/49
6,312,099 B1 11/2001 Hawkins et al. ..... 347/42
6,341,845 B1 1/2002 Scheffelin et al. ..... 347/50
6,350,013 B1 2/2002 Scheffelin et al. ..... 347/49
6,394,580 B1 5/2002 Scheffelin et al. ..... 347/50
6,409,307 B1 6/2002 Akhavain et al. ..... 347/42
6,428,145 B1 8/2002 Feinn et al. ..... 347/50
6,435,653 B1 8/2002 Boyd et al. ..... 347/42
6,450,614 B1 9/2002 Scheffelin et al. ..... 347/42
6,464,333 B1 10/2002 Scheffelin et al. ..... 347/42
6,502,920 B1 * 1/2003 Anderson et al. ..... 347/40

* cited by examiner

*Primary Examiner*—Hai Pham
*Assistant Examiner*—Lam Nguyen

(57) ABSTRACT

A fluid ejection device includes a first edge and an electrical interconnect disposed along the first edge. The fluid ejection device also includes a second edge opposite the first edge. Multiple dies are disposed on the fluid ejection device such that a pair of dies are disposed adjacent the second edge and another die is disposed adjacent the first edge. Each die contains at least one drop-ejecting element. Multiple fluid ejection devices are arranged such that the second edges of the fluid ejection devices are adjacent one another.

18 Claims, 5 Drawing Sheets

MULTI-DIE FLUID EJECTION APPARATUS AND METHOD

TECHNICAL FIELD

The present invention relates to fluid ejection devices.

BACKGROUND

Conventional fluid ejection systems, such as inkjet printing systems, include a printhead, an ink supply that provides liquid ink to the printhead, and an electronic controller that controls the printhead. The printhead ejects ink drops through multiple nozzles (also referred to as orifices) toward a print medium, such as a sheet of paper, thereby printing onto the print medium. Typically, the multiple nozzles are arranged in one or more arrays such that properly sequenced ejection of ink from the nozzles causes characters or other images to be printed on the print medium as the printhead and the print medium are moved relative to one another.

In a particular arrangement, commonly referred to as a wide-array inkjet printing system, multiple individual printheads (also referred to as printhead assemblies) are mounted on a single carrier. In this arrangement, the number of nozzles and, therefore, the overall number of ink drops that can be ejected per second is increased. Since the overall number of ink drops that can be ejected per second is increased, printing speed can be increased with the wide-array inkjet printing system.

Mounting multiple printhead assemblies on a single carrier can result in an irregular spacing between the multiple arrays of nozzles in the multiple printhead assemblies and between nozzles in printhead assemblies on different carriers. If the movement of the printhead is generally constant, this irregular spacing of nozzles results in irregular time delays between ejection of adjacent ink drops. For example, the time delay between ink drops ejected from adjacent nozzles in the same assembly is relatively small. However, the time delay between ink drops ejected from adjacent nozzles in different assemblies may be significantly larger. Further, the time delay is even greater between ink drops ejected from adjacent nozzles in two different assemblies located on different carriers.

The variance in the distance between adjacent nozzles can cause visible artifacts in the printed image due to non-uniform drying times of the ink drops, non-uniform interaction between the ink and the print medium, and non-uniform interactions between multiple ink drops. These visible artifacts degrade the quality of the printed image.

SUMMARY

An embodiment of the present invention provides a fluid ejection device and method of operation that enhances the uniformity with which fluid drops are deposited on a medium. In one embodiment, a fluid ejection device includes a first edge and an electrical interconnect disposed along the first edge. The fluid ejection device also includes a second edge that is opposite the first edge. Multiple dies are disposed on the fluid ejection device. Each of the multiple dies contains at least one drop-ejecting element. Two of the multiple dies are disposed adjacent the second edge and another die is disposed adjacent the first edge. Multiple fluid ejection devices are arranged such that the second edges of the fluid ejection devices are adjacent one another.

BRIEF DESCRIPTION OF THE DRAWINGS

The systems and methods discussed herein are illustrated by way of example and not limitation in the figures of the accompanying drawings. The same numbers are used throughout the figures to reference like components and/or features.

DETAILED DESCRIPTION

The systems and methods described herein provide a fluid ejection device and method of operation suitable for use with inkjet printing systems and other systems that utilize fluid ejection devices. In particular, a fluid ejection device contains multiple dies arranged in rows such that the spacing between adjacent rows is substantially uniform regardless of whether the adjacent rows are located on the same fluid ejection device or located on adjacent fluid ejection devices. Although particular examples described herein refer to inkjet printing systems, the systems and methods discussed herein are applicable to any fluid ejection device or component.

Figure 1:
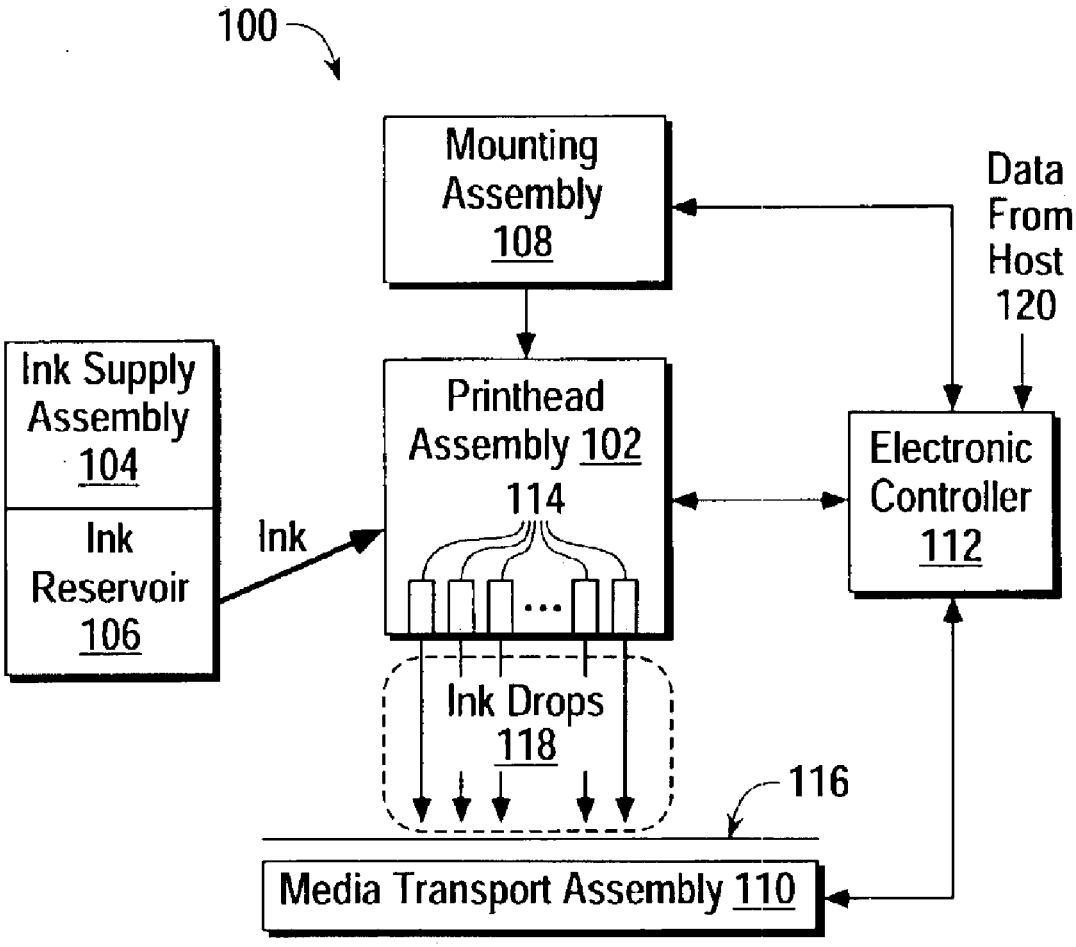
FIG. 1 is a block diagram illustrating an embodiment of an inkjet printing system.

FIG. 1 is a block diagram illustrating an embodiment of an inkjet printing system 100. Inkjet printing system 100 includes a printhead assembly 102, an ink supply assembly 104, a mounting assembly 108, a media transport assembly 110 and an electronic controller 112. Printhead assembly 102 is formed according to an embodiment of the present invention, and includes one or more printheads that eject drops of ink through multiple nozzles 114 and toward a print medium 116 so as to print onto print medium 116. Nozzles 114 may also be referred to as orifices. Print medium 116 may be any type of material such as paper, card stock, transparencies, Mylar and the like. Typically, nozzles 114 are arranged in one or more columns (or arrays) such that properly sequenced ejection of ink from nozzles 114 causes characters, symbols, and/or other graphics or images to be printed on print medium 116 as printhead assembly 102 and print medium 116 are moved relative to one another.

Ink supply assembly 104 supplies ink to printhead assembly 102 and includes an ink reservoir 106 that stores ink. Ink flows from ink reservoir 106 to printhead assembly 102. Ink supply assembly 104 and printhead assembly 102 can form either a one-way ink delivery system or a recirculating ink delivery system. In a one-way ink delivery system, substantially all of the ink supplied to printhead assembly 102 is consumed during printing. In a recirculating ink delivery system, only a portion of the ink supplied to printhead assembly 102 is consumed during printing. Ink that is not consumed during printing is returned to ink supply assembly 104.

In one embodiment, printhead assembly 102 and ink supply assembly 104 are housed together in an inkjet cartridge or pen. In another embodiment, ink supply assembly 104 is separate from printhead assembly 102 and supplies ink to printhead assembly 102 through an interface connection, such as a supply tube. In either embodiment, ink reservoir 106 of ink supply assembly 104 may be removed, replaced, or refilled. In one embodiment, where printhead assembly 102 and ink supply assembly 104 are housed together in an inkjet cartridge, ink reservoir 106 includes a local reservoir located within the cartridge as well as a larger reservoir located separately from the cartridge. In this embodiment, the separate, larger reservoir serves to refill the local reservoir. The separate, larger reservoir and/or the local reservoir can be removed, replaced, or refilled.

Mounting assembly 108 positions printhead assembly 102 relative to media transport assembly 110. Media transport assembly 110 positions print medium 116 relative to printhead assembly 102. A print zone 118 is defined adjacent to nozzles 114 in an area between printhead assembly 102 and print medium 116. In one embodiment, printhead assembly 102 is a scanning type printhead assembly. In this embodiment, mounting assembly 108 includes a carriage that moves printhead assembly 102 relative to media transport assembly 110 to scan print medium 116. In another embodiment, printhead assembly 102 is a non-scanning type printhead assembly. In this embodiment, mounting assembly 108 fixes printhead assembly 102 at a particular position relative to media transport assembly 110. Media transport assembly 110 positions print medium 116 relative to printhead assembly 102.

Electronic controller 112 communicates with printhead assembly 102, mounting assembly 108 and media transport assembly 110. Electronic controller 112 receives data 120 from a host system, such as a computer, and includes memory capable of temporarily storing data 120. Typically, data 120 is sent to inkjet printing system 100 along an electronic, infrared, optical, or other information transfer path. Data 120 represents, for example, a document and/or file to be printed. In one embodiment, data 120 forms a print job for inkjet printing system 100 and includes one or more print job commands and/or command parameters.

In a particular embodiment, electronic controller 112 provides control of printhead assembly 102 including timing control for ejection of ink drops from nozzles 114. Electronic controller 112 defines a pattern of ejected ink drops that form characters, symbols, and/or other graphics or images on print medium 116. Timing control and the pattern of ejected ink drops is determined by, for example, the print job commands and/or command parameters. In one embodiment, logic and drive circuitry forming a portion of electronic controller 112 is incorporated in an integrated circuit (IC) located on printhead assembly 102. In another embodiment, logic and drive circuitry is located off printhead assembly 102.

Figure 2:
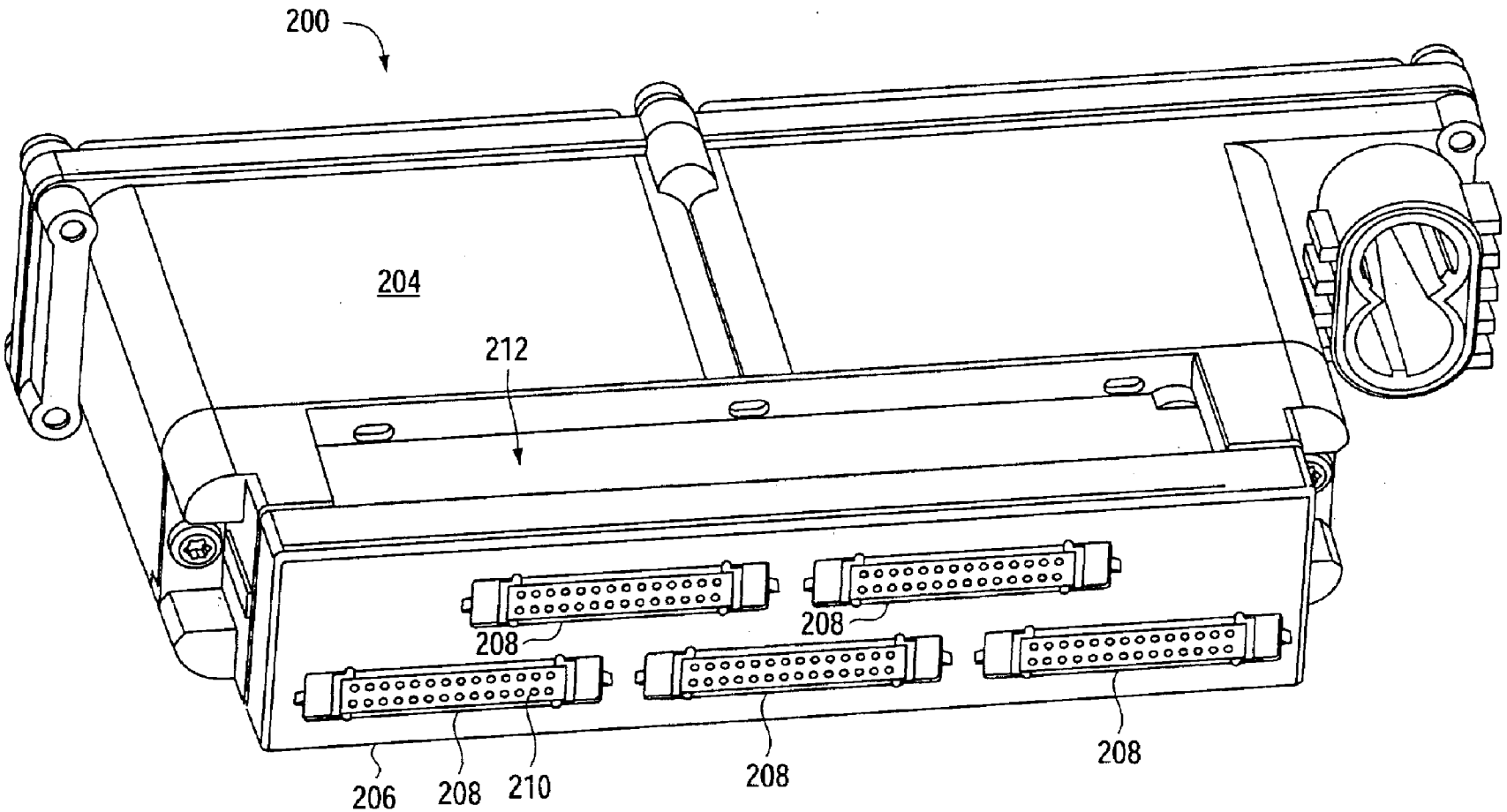
FIG. 2 is a perspective view of an example pen containing a printhead assembly with multiple printhead dies.

FIG. 2 is a perspective view of an example pen (or cartridge) 200 containing a printhead assembly with multiple printhead dies. Pen 200 may be used, for example, in a wide-array or multi-pen printhead assembly. Pen 200 includes a body 204 to which is mounted a printhead assembly 206. In this embodiment, printhead assembly 206 includes five printhead dies 208 arranged in two rows. Each printhead die 208 contains an array of drop-ejecting elements 210. A particular printhead die 208 may contain any number of drop-ejecting elements 210.

Pen 200 also includes a recessed portion 212 that, for example, provides access to electrical contacts (not shown) on the side of printhead assembly 206 opposite the printhead dies 208. The electrical contacts may engage an electrical connector or other device positioned in recessed portion 212. Alternatively, the electrical contacts may be positioned at other locations on printhead assembly 206. As discussed below, multiple pens may be coupled together in a particular printing device.

Figure 3:
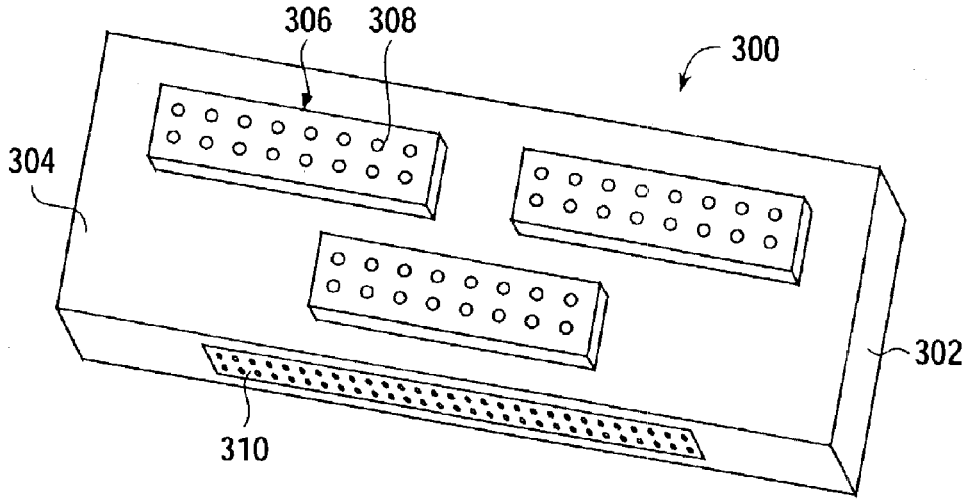
FIG. 3 illustrates an embodiment of a printhead assembly having multiple printhead dies.

FIG. 3 illustrates an embodiment of a printhead assembly 300 having multiple printhead dies. Printhead assembly 300 can be part of a wide-array or multi-head printhead assembly. Printhead assembly 300 includes a substrate 302 that has a first surface 304. Three printhead dies 306 are located on the first surface 304 of substrate 302. Each printhead die 306 contains an array of drop-ejecting elements 308. In the example of FIG. 3, each printhead die 306 contains 16 drop-ejecting elements 308. In alternate embodiments, each printhead die 306 may contain any number of drop-ejecting elements 308. Additionally, each printhead die 306 in FIG. 3 contains the same number of drop-ejecting elements 308. Alternatively, different printhead dies 306 may contain different numbers of drop-ejecting elements 308.

Printhead assembly 300 also includes an electrical interconnect 310 that is used to couple the printhead assembly 300 to an electronic controller or similar device (such as electronic controller 112 in FIG. 1). Electrical interconnect 310 typically includes multiple electrical contacts (also referred to as input/output contacts). Electrical contacts may include, for example, pins that engage corresponding receptacles coupled to the electronic controller, and pads or fingers that contact corresponding electrical nodes coupled to the electronic controller. Although a particular type of electrical interconnect 310 is shown in FIG. 3, alternate embodiments of printhead assembly 300 may utilize any type of electrical interconnection device. Also, electrical interconnect 310 may be located at various other locations on printhead assembly 300.

Figure 4:
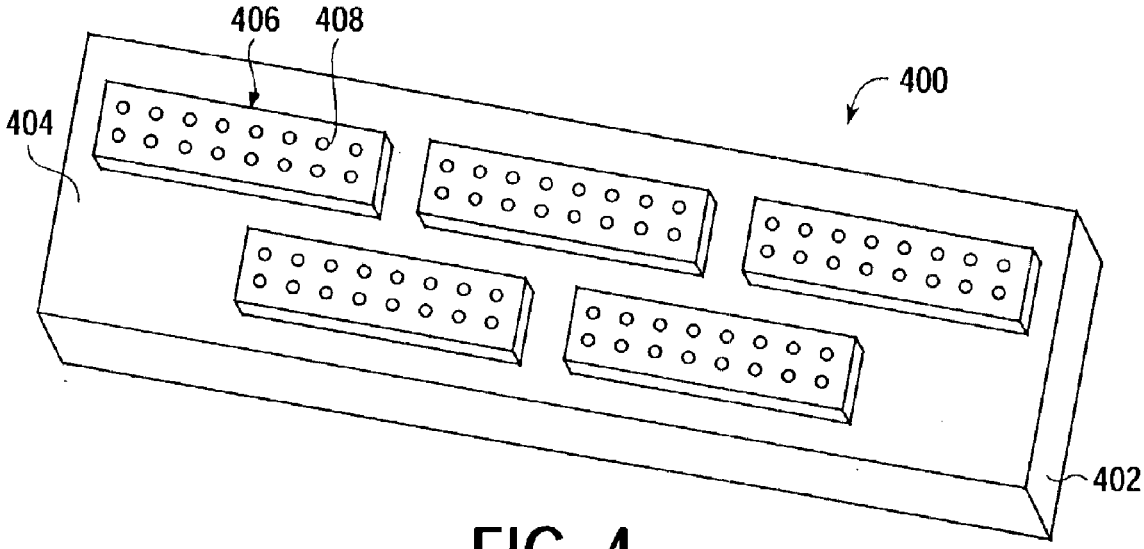
FIG. 4 illustrates another embodiment of a printhead assembly having multiple printhead dies.

FIG. 4 illustrates another embodiment of a printhead assembly 400 having multiple printhead dies. Printhead assembly 400 may be part of a wide-array or multi-head printhead assembly. Printhead assembly 400 includes a substrate 402 that has a first surface 404. Five printhead dies 406 are located on the first surface 404 of substrate 402. Each of the printhead dies 406 contains an array of drop-ejecting elements 408. In the embodiment shown in FIG. 4, each printhead die 406 contains 16 drop-ejecting elements 408. As discussed above, alternate printhead dies 406 may include any number of drop-ejecting elements 408.

Printhead assembly 400 also includes an electrical interconnect (not shown) that is used to couple the printhead assembly 400 to an electronic controller or similar device (such as electronic controller 112 in FIG. 1). Any type of electrical interconnect device can be used with printhead assembly 400 and can be positioned at various locations on printhead assembly 400.

In the embodiments of FIGS. 3 and 4, printhead dies 306/406 are spaced apart and staggered with respect to one another such that a portion of printhead dies 306/406 in one row overlap at least a portion of one printhead die 306/406 in another row. Thus, the illustrated printhead assembly is able to span a nominal page width or a width shorter or longer than nominal page width. FIGS. 3 and 4 illustrate printhead assemblies containing three and five printhead dies, respectively. In alternate embodiments, a printhead assembly may contain any number of printhead dies.

In a particular implementation, a printhead assembly includes an odd number of printhead dies, such as three printhead dies or five printhead dies as discussed herein. The odd number of printhead dies are arranged, for example, in two rows where one row contains one less printhead die than the other row. The rows of printhead dies are arranged such that the printhead dies in one row span the "gaps" between adjacent printhead dies in the other row. For example, as shown in FIG. 3, in the row containing a single printhead die, that printhead die spans the "gap" between the two printhead dies in the other row. Additionally, the printhead dies in one row "overlap" at least a portion of one or more printhead dies in the other row. For example, as shown in FIG. 3, the single printhead die "overlaps" a portion of the two printhead dies in the other row.

Example embodiments of printhead dies 306/406 include a thermal printhead, a piezoelectric printhead, a flex-tensional printhead, or any other type of fluid ejection device. Although various embodiments discussed herein describe the ejection of ink, the systems and methods described herein can be applied to the ejection of any type of liquid.

The figures discussed herein are not necessarily drawn to scale. The relative sizes and positioning of the illustrated components and features may vary from that shown in the drawings.

The example printhead dies discussed herein may be a single color or multiple colors. Printhead dies that are multiple colors support, for example, different colors in each row of drop-ejecting elements. In the examples shown here, each printhead die has an array of drop-ejecting elements that contain two rows of elements. Each of these rows of drop-ejecting elements may be a different color. In this configuration, several printhead assemblies provide full color printing. Full color printing typically uses four to eight different colors. In alternate embodiments, each printhead die supports a single color (i.e., all drop-ejecting elements in the printhead die eject the same color of ink).

Figure 5:
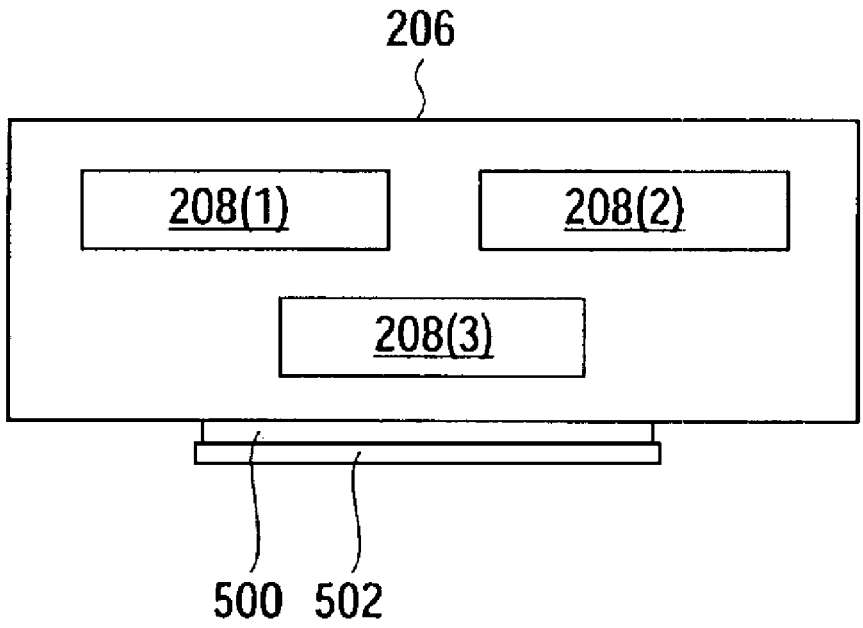
FIG. 5 illustrates an embodiment of a printhead assembly.

FIG. 5 illustrates an embodiment of a printhead assembly 206 in which a connector 500 on the printhead assembly engages a mating connector 502. As discussed above with reference to FIG. 2, printhead assembly 206 includes three printhead dies 208, labeled 208(1), 208(2) and 208(3), and electrical interconnect 500. Mating connector 502 may be attached to a mounting assembly, a conductive cable, or other device. In one embodiment, connector 502 is coupled to an electronic controller, such as electronic controller 112 of FIG. 1.

A particular mounting assembly can be used to support printhead assemblies having any number of printhead dies. Further, a mounting assembly can support multiple printhead assemblies.

Figure 6:
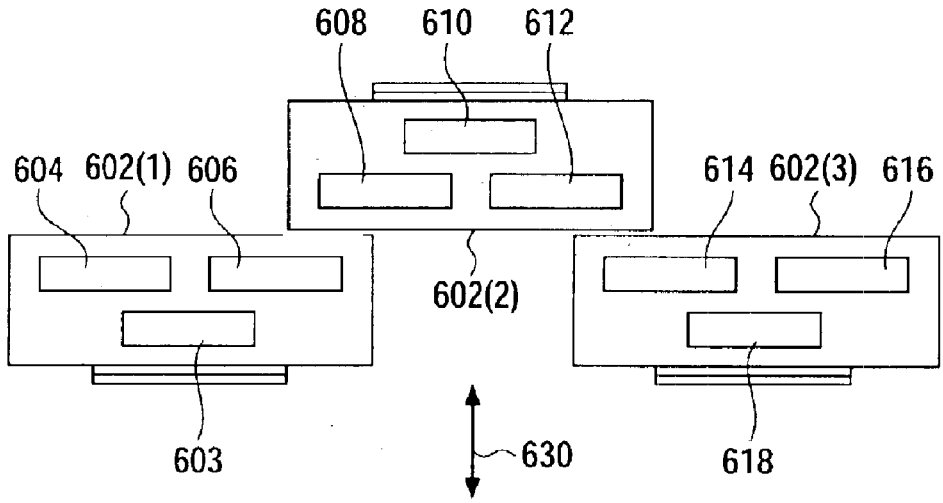
FIGS. 6 and 7 illustrate exemplary arrangements of multiple printhead assemblies in which each printhead assembly has multiple printhead dies.
Figure 7:
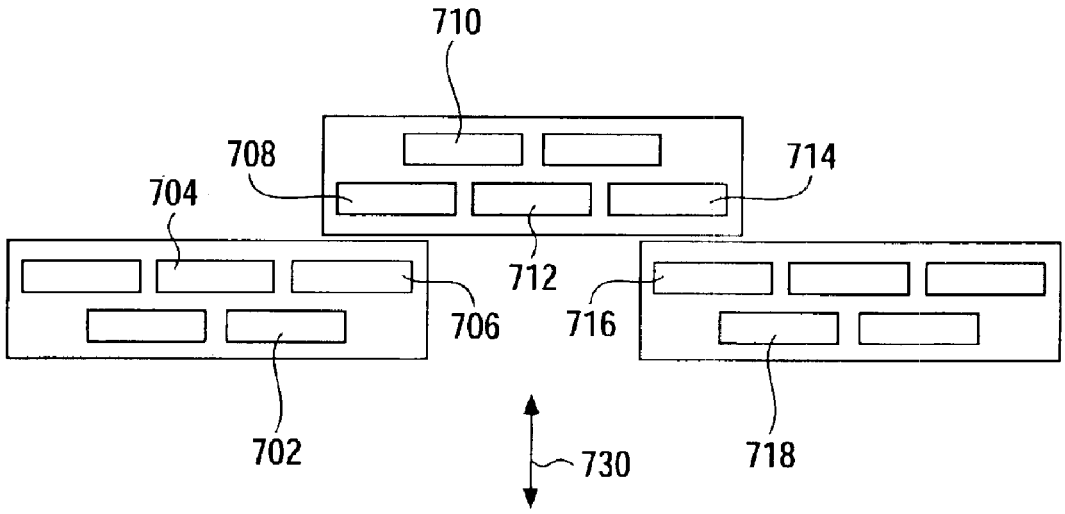

FIGS. 6 and 7 illustrate exemplary arrangements of multiple printheads in which each printhead has multiple printhead dies. In FIG. 6, three printheads 602(1), 602(2) and 602(3) are shown. In a particular embodiment, printheads 602(1), 602(2) and 602(3) are mounted to a structure similar to that shown in FIG. 2. Additionally, particular embodiments of printheads 602(1), 602(2) and 603(3) are similar to printhead 206 shown in FIG. 2.

Printhead 602(1) includes printhead dies 603, 604 and 606. Printhead 602(2) includes printhead dies 608, 610 and 612. Printhead 602(3) includes printhead dies 614, 616 and 618. Printheads and/or their mounting assemblies may be physically coupled to one another to prevent movement of one assembly with respect to another. Alternatively, printheads and/or their mounting assemblies can be coupled to another device or structure that secures the positioning of the assemblies.

The various printhead dies 603–618 shown in FIG. 6 can be viewed as being arranged in four rows. A first row contains printhead dies 603 and 618, a second row contains printhead dies 604, 606, 614 and 616, a third row contains printhead dies 608 and 612, and a fourth row contains printhead die 610. The arrangement shown in FIG. 6 results in a substantially uniform spacing between adjacent rows of printhead dies, regardless of whether the rows of printhead dies are located on the same printhead or different printheads. For example, the spacing between printhead dies 603 and 606 is substantially the same as the spacing between printhead dies 606 and 608, which is substantially the same as the spacing between printhead dies 608 and 610. Similarly, the spacing between printhead dies 610 and 612 is substantially the same as the spacing between printhead dies 612 and 614, which is substantially the same as the spacing between printhead dies 614 and 618. This substantially uniform spacing between printhead dies results in a substantially uniform spacing between adjacent arrays of drop-ejecting elements contained in the printhead dies. This substantially uniform spacing of the drop-ejecting elements results in a more uniform deposition of ink drops on the print medium. This enhanced uniformity in the deposition of ink drops on the print medium reduces visible artifacts in the printed image, thereby enhancing the quality of the printed image.

In particular embodiments, the linear distance between adjacent rows of printhead dies is approximately twice the linear distance between a printhead die and the nearest edge of the printhead assembly with which the printhead die is associated. In the example of FIG. 6, the linear distance between printhead dies 603 and 606 is approximately twice the linear distance between printhead die 606 and the edge of the printhead assembly on which printhead die 606 is located. Similarly, the linear distance between printhead die 608 and the edge of the printhead assembly on which it is located is approximately one-half the distance between printhead dies 608 and 610. Thus, the total linear distance between printhead dies 606 and 608 is approximately equal to the spacing between printhead dies 603 and 606, and between printhead dies 608 and 610. In a particular embodiment, print media moves in a substantially vertical manner (as indicated by an arrow 630) with respect to the printhead assemblies. Alternatively, print media may move in any direction with respect to the printhead assemblies.

As shown in FIG. 6, the orientation of printhead assembly 602(2) is rotated 180 degrees as compared to mounting assemblies 602(1) and 602(3). This change in orientation is useful to maintain the substantially uniform spacing between adjacent rows of printhead dies, including printhead dies associated with different mounting assemblies. If the orientation of mounting assembly 602(2) was not rotated 180 degrees, the base portion of mounting assembly 602(2) would interfere with the spacing between the second and third rows.

Referring to FIG. 7, three printhead assemblies are shown. The embodiment of FIG. 7 is similar to the embodiment discussed above with respect to FIG. 6, but the printheads in FIG. 7 each contain five printhead dies instead of three printhead dies. Additionally, a different type of connector is used to couple the printhead assemblies to an electronic controller.

The various printhead dies shown in FIG. 7 can be viewed as being arranged in four rows. A first row that includes printhead dies 702 and 718, a second row that includes printhead dies 704, 706 and 716, a third row that includes printhead dies 708, 712 and 714, and a fourth row that includes printhead die 710. The arrangement shown in FIG. 7 results in a substantially uniform spacing between adjacent rows of printhead dies, regardless of whether the rows of printhead dies are located on the same printhead or different printheads. For example, the spacing between printhead dies 702 and 706 is substantially the same as the spacing between printhead dies 706 and 708, which is substantially the same as the spacing between printhead dies 708 and 710. Similarly, the spacing between printhead dies 710 and 712 is substantially the same as the spacing between printhead dies 714 and 716, which is substantially the same as the spacing between printhead dies 716 and 718. This substantially uniform spacing between printhead dies results in a substantially uniform spacing between adjacent arrays of drop-ejecting elements contained in the printhead dies. This substantially uniform spacing of the drop-ejecting elements results in a more uniform deposition of ink drops on the print medium, which reduces visible artifacts in the printed image, thereby enhancing the quality of the printed image.

In a particular embodiment, print media moves in a substantially vertical manner (as indicated by an arrow 730) with respect to the printhead assemblies. Alternatively, print media may move in any direction with respect to the printhead assemblies.

In the embodiment shown in FIG. 6, the printhead dies on each printhead are arranged such that n printhead dies are located in a row closest to the printhead's electrical interconnect and n+1 printhead dies are located in a row furthest from the printhead's electrical interconnect. This arrangement provides overlap between printhead dies in adjacent rows, including adjacent rows on different printheads.

Although the embodiments of FIGS. 6 and 7 illustrate printheads with two rows of printhead dies, alternate embodiments may include any number of rows of printhead dies. Additionally, although FIGS. 6 and 7 each illustrate three printhead assemblies, alternate embodiments may include any number of printhead assemblies.

Although the invention has been described in language specific to structural features and/or methodological steps, it is to be understood that the invention defined in the appended claims is not necessarily limited to the specific features or steps described. Rather, the specific features and steps are disclosed as particular examples of implementing the claimed invention.

What is claimed is:

1. An apparatus comprising:

a plurality of fluid ejection devices, wherein each fluid ejection device includes:

a first edge;

an electrical interconnect disposed along the first edge;

a second edge opposite the first edge;

a plurality of dies wherein each die contains at least one drop-ejecting element, and wherein the plurality of dies includes a pair of dies disposed adjacent the second edge and another die disposed adjacent the first edge;

wherein the plurality of fluid ejection devices are arranged such that the second edges of the fluid ejection devices are adjacent one another.

2. The apparatus according to claim 1 wherein the plurality of dies are arranged in a plurality of rows.

3. The apparatus according to claim 1 wherein the plurality of dies are arranged in a plurality of rows, and wherein each die in a particular row overlaps at least a portion of a die in an adjacent row.

4. The apparatus according to claim 1 wherein the plurality of dies are arranged in a plurality of rows, and wherein at least one die in a particular row spans a gap between two dies in an adjacent row.

5. The apparatus according to claim 1 wherein spacing between adjacent dies on a single fluid ejection device is substantially the same as spacing between adjacent dies on adjacent fluid ejection devices.

6. The apparatus according to claim 1 wherein a linear distance between adjacent dies on a single fluid ejection device is approximately twice a linear distance between a die and a nearest edge of the fluid ejection device with which the die is associated.

7. The apparatus according to claim 1 wherein the plurality of dies on each fluid ejection device are arranged in a plurality of rows, and wherein spacing between adjacent rows of dies is substantially uniform.

8. The apparatus according to claim 1 wherein the plurality of dies is an odd number of dies.

9. The apparatus according to claim 1 wherein the fluid ejection devices are inkjet printheads.

10. An apparatus comprising:

a first fluid ejection device;

a second fluid ejection device;

a third fluid ejection device, wherein each of the fluid ejection devices includes:

a first edge;

an electrical interconnect disposed along the first edge;

a second edge opposite the first edge;

a plurality of dies having at least one drop-ejecting element, wherein the plurality of dies includes a pair of dies disposed adjacent the second edge and another die disposed adjacent the first edge;

wherein the fluid ejection devices are arranged such that the second edge of the first fluid ejection device is adjacent the second edge of the second fluid ejection device and the second edge of the second fluid ejection device is adjacent the second edge of the third fluid ejection device.

11. The apparatus according to claim 10 wherein the plurality of dies on each fluid ejection device are arranged in a plurality of rows.

12. The apparatus according to claim 10 wherein the plurality of dies on each fluid ejection device are arranged in a plurality of rows, and wherein each die in a particular row overlaps at least a portion of a die in an adjacent row.

13. The apparatus according to claim 10 wherein the plurality of dies on each fluid ejection device are arranged in a plurality of rows, and wherein at least one die in a particular row spans a gap between two dies in an adjacent row.

14. An apparatus comprising:

a plurality of fluid ejection devices, wherein each fluid ejection device includes:

a first edge;

a first row of n dies disposed adjacent the first edge, wherein each of the n dies contains at least one drop-ejecting element;

a second edge opposite the first edge;

a second row of n+1 dies disposed adjacent the second edge, wherein each of the n+1 dies contains at least one drop-ejecting element;

wherein the plurality of fluid ejection devices are arranged such that the second edges of the fluid ejection devices are adjacent one another.

15. The apparatus according to claim 14 wherein spacing between the first row of dies and the second row of dies on a single fluid ejection device is substantially the same as spacing between the second row of dies on a first fluid ejection device and the second row of dies on a second fluid ejection device.

16. The apparatus according to claim 14 wherein at least one die in the first row spans a gap between two dies in the second row.

17. The apparatus according to claim 14 wherein the each die in the first row overlaps at least a portion of a die in the second row.

18. A method comprising:

providing a plurality of fluid ejection devices, wherein each fluid ejection device includes a first edge, an electrical connector disposed along the first edge, a second edge, and a plurality of dies wherein each die contains at least one drop-ejecting element, and wherein the plurality of dies includes a pair of dies adjacent the second edge and another die disposed adjacent the first edge; and positioning the plurality of fluid ejection devices such that the second edges of the fluid ejection devices are adjacent one another.

* * * * *